US005635084A

United States Patent [19]

Mansfeld et al.

[11] Patent Number: 5,635,084

[45] Date of Patent: Jun. 3, 1997

[54] METHOD FOR CREATING A CORROSION-RESISTANT SURFACE ON AN ALUMINUM-COPPER ALLOY

[75] Inventors: Florian B. Mansfeld, Playa del Rey, Calif.; You Wang, Jingshou, China; Simon H. Lin, San Dimas, Calif.

[73] Assignee: University of Southern California, Los Angeles, Calif.

[21] Appl. No.: 447,075

[22] Filed: May 22, 1995

Related U.S. Application Data

[63] Continuation-in-part of Ser. No. 247,147, May 20, 1994, Pat. No. 5,582,654.

[51] Int. Cl.[6] ..... B44C 1/22

[52] U.S. Cl. ..... 216/106; 216/105

[58] Field of Search ..... 216/106, 105

[56] References Cited

U.S. PATENT DOCUMENTS

| | | | |
|---|---|---|---|
| 2,512,493 | 6/1950 | Gide . | |
| 3,537,895 | 11/1970 | Lancy | 216/106 |
| 3,728,188 | 4/1973 | Yarrington . | |
| 3,859,149 | 1/1975 | Kay | 216/106 |
| 3,960,676 | 6/1976 | Miyosawa et al. . | |
| 3,969,152 | 7/1976 | Melotik . | |
| 4,337,114 | 6/1982 | Russell | 216/106 |
| 4,362,335 | 12/1982 | Rungta . | |
| 4,451,304 | 5/1984 | Batiuk . | |
| 4,610,732 | 9/1986 | Sasaki et al. . | |
| 4,988,396 | 1/1991 | Bibber . | |
| 4,992,115 | 2/1991 | Ikeda . | |
| 5,192,374 | 3/1993 | Kindler . | |
| 5,194,138 | 3/1993 | Mansfeld et al. . | |

FOREIGN PATENT DOCUMENTS

| | | |
|---|---|---|
| PCT/AU88/00060 | 3/1988 | WIPO . |

OTHER PUBLICATIONS

"The Inhibition of Aluminum Alloy Corrosion By Cerous Cations" by B.R.W. Hinton, D.R. Arnott, and N.E. Ryan, in *Metals Forum*, vol. 7, No.4 (1984).

"Cationic Film Forming Inhibitors for The Protection of 7075 Aluminum Alloy Against Corrosion in Aqueous Chloride Solution" by D.R. Arnott, B.R.W. Hinton, and N.E. Ryan, published in *Corrosion 86*, Paper No. 197, Mar. 17–21, 1986.

"Cerium Conversion Coatings for the Corrosion Protection of Aluminum*" by B.R.W. Hinton, D.R. Arnott, and N.E. Ryan, *Materials Forum*, vol. 9, No. 3 (1986).

"Surface Modification of A1 Alloys and A1–Based Metal Matrix Composites by Chemical Passivation" by F. Mansfeld, S. Lin, S. Kim and H. Shih, published in *Electrochimica Acta*, vol. 34, No. 8, pp. 1123–1132 (1989).

"Corrosion Protection of Al Alloys and Al–Based Metal Matrix Composites by Chemical Passivation," by F. Mansfeld, S. Lin, S. Kim, and H. Shih, published in *Corrosion*, vol. 45, No. 8, pp. 615–631 (1989) Aug.

"Corrosion Inhibition with Rate Earth Metal Salts," by B.R.W. Hinton, published in *Journal of Alloys and Compounds*, 180 (1992) 15–25.

"Corrosion Protection of High–Copper Aluminum Alloys by Surface Modification" by F. Mansfeld and Y. Wang, a publication of the British Corrosion Journal, vol. 29, No. 3 (3rd Quarter 1994).

"Improvement of the Corrosion Resistance of High–Copper Aluminum Alloys "by S.H. Lin, published at the 185th Meeting of the Electrochemical Society, San Francisco, CA, May 22–27, 1994.

"Corrosion Protection of High–Copper Aluminum Alloys by Surface Modification" by Y. Wang, published at the 185th Meeting of the Electrochemical Society, San Francisco, CA, May 22–27, 1994.

*Primary Examiner*—Sam Silverberg

*Attorney, Agent, or Firm*—Denton L. Anderson; David A. Farah; Sheldon & Mak, Inc.

[57] ABSTRACT

A method for treating the surface of aluminum alloys hang a relatively high copper content is provided which includes the steps of removing substantially all of the copper from the surface, contacting the surface with a first solution containing cerium, electrically charging the surface while contacting the surface in an aqueous molybdate solution, and contacting the surface with a second solution containing cerium. The copper is substantially removed from the surface in the first step either by (i) contacting the surface with an acidic chromate solution or by (ii) contacting the surface with an acidic nitrate solution while subjecting the surface to an electric potential. The corrosion-resistant surface resulting from the invention is excellent, consistent and uniform throughout the surface. Surfaces treated by the invention may often be certified for use in salt-water services.

10 Claims, No Drawings

METHOD FOR CREATING A CORROSION-RESISTANT SURFACE ON AN ALUMINUM-COPPER ALLOY

This invention was made with federal government support under Contract No. N00014-91-J-1041 awarded by the Office of Naval Research and Contract No. AH-1623 awarded by Sandia National Laboratories. The federal government, therefore, has certain rights in the invention.

RELATED APPLICATION

This application is a continuation-in-part of U.S. patent application Ser. No. 08/247,147, filed May 20, 1994, now U.S. Pat. No. 5,582,654 the contents of which are incorporated herein in its entirety.

FIELD OF THE INVENTION

This invention relates generally to methods for increasing the corrosion resistance of aluminum-based alloys, and specifically to methods of increasing the corrosion resistance of aluminum-copper alloys.

BACKGROUND OF THE INVENTION

Aluminum-based materials and aluminum-containing composites are known to be relatively resistant to oxidation corrosion. However, such materials are susceptible to pitting corrosion when exposed to acids and halides. For example, aluminums deteriorate rapidly when exposed to sea water. Even aluminum alloys which are only exposed to the atmosphere will deteriorate with time because of pitting corrosion caused by acidic air pollutants and acid rain.

Traditionally, there have been two commonly used methods of increasing the pitting corrosion resistance of aluminum alloys: anodizing and passivation with chromate solutions. Neither of these methods, however, is wholly satisfactory. Anodizing involves a complex and expensive multi-step procedure. Chromate passivation involves a less complex procedure, but does not provide long-term corrosion protection. Chromate passivation, for example, does not provide sufficient pitting corrosion protection to allow aluminum-based materials to be used in marine environments.

Two of us (Mansfeld and Wang) have recently participated in the development of a third method of increasing the pitting corrosion-resistance of aluminums. This third method is described in U.S. Pat. No. 5,194,138 which is incorporated herein by reference in its entirety. In this third method, aluminum-based materials are first contacted with an aqueous cerium non-halide solution and thereafter contacted with a cerium halide solution. This new process is simpler and less expensive than anodizing methods. It also yields superior results to results obtained from chromate pacification methods.

Unfortunately, neither anodizing, chromate pacification, nor even the new cerium solution treatment works particularly well on aluminum-copper alloys wherein the copper content of the alloy is more than about one percent. These alloys, such as Aluminum Associate alloy types Al 7075 (1.2–2.0% copper) and Al 2024 (3.8–4.9% copper), have become increasingly popular because they possess certain mechanical properties which are superior to other aluminum alloys. Unfortunately, however, they cannot be made substantially resistant to localized corrosion by any known method.

Accordingly, there is a need for a method of increasing the corrosion resistance of aluminum alloys wherein the copper content is greater than about one percent.

SUMMARY OF THE INVENTION

The invention satisfies this need. The invention is a method of treating the surface of a high copper content aluminum alloy so as to make that surface resistant to corrosion. This method comprises the steps of (a) removing substantially all of the copper from the metallic matrix at the surface of the alloy; (b) contacting the substantially copper-free surface with a first cerium-containing solution; (c) contacting the surface with an aqueous molybdate solution; and (d) contacting the surface with a second cerium-containing solution.

The copper which is removed from the surface is not merely copper salts formed above the metallic matrix, but the metallic copper actually existing within the matrix. Thus, after the copper is removed from the surface, not only are copper salts removed from above the surface, but also the interstitial copper is removed from the metallic matrix of the surface itself.

In one preferred embodiment useful in making corrosion resistant the surface of an aluminum alloy having between about one and two percent copper, the substantially copper-free surface from step (a) is first contacted with a cerium nitrate solution. Thereafter, the surface is contacted with an aqueous solution of sodium molybdate while the surface is electrically charged. Finally, the surface is emersed in an aqueous solution of cerium chloride.

In a second preferred embodiment, useful in making corrosion resistant the surface of an aluminum alloy having greater than about two percent copper, the substantially copper-free surface from step (a) is first contacted with a cerium acetate solution. Thereafter, the surface is treated with an aqueous solution of sodium molybdate while the surface is electrically charged. Finally, the surface is emersed in an aqueous solution of cerium nitrate.

The invention is also a chemical method of removing substantially all of the copper from the surface of the aluminum alloy in step (a). In this method, the surface is first contacted with an acidic chromate-containing solution, followed by rinsing with the water and then immediate emersion in a nitric acid bath.

The invention is also an electrochemical method of removing substantially all of the copper from the surface of the aluminum alloy in step (a). In this method, the surface is electrically charged while being emersed in an acidic nitrate-containing solution, followed by rinsing with water.

The invention has been found to be a vastly superior method for inhibiting the corrosion of aluminum alloys having relatively high copper content.

DETAILED DESCRIPTION

In the previous section, the invention has been generally described. In the present section, specific embodiments of the invention will be described in detail. This detailed description, however, should not in any way be deemed to limit the scope of the invention more narrowly than that of the appended claims.

The invention is a unique method for treating the surface of an aluminum alloy having a relatively high copper content, so as to make that surface resistant to corrosion. The method comprises the steps of: (a) removing substantially all of the copper from the metallic matrix at the surface of the alloy; (b) contacting the surface with a first solution containing cerium; (c) electrically charging the surface while contacting the surface with an aqueous molybdate solution; and (d) contacting the surface with a second solution containing cerium.

Preferably the method further comprises the initial steps of degreasing and deoxidizing the surface of the alloy prior to removing substantially all of the copper from the surface of the alloy in step (a). Degreasing of the surface can be accomplished by washing the surface with a detergent, such as the Alconox brand detergent. In a typical degreasing operation, the alloy is first emersed in Alconox for about one minute. Thereafter, it is wiped with Alconox and then rinsed with water.

The surface can be deoxidized by contacting the surface with any of the many commercially sold deoxidizing solutions, such as Diversey 560, manufactured and sold by Diversey Wyandotte Company. Diversey 560 is a 15 volume percent solution with active ingredients which comprise about 25% sulfuric acid, about 15% nitric acid, and about 2% hydrofluorosilic acid.

The removal of substantially all of the copper from the metallic matrix at the surface of the alloy can be accomplished either by a unique chemical method or by a unique electrochemical method.

The unique chemical method for removing substantially all of the copper content from the metallic matrix at the surface of the alloy comprises the steps of (i) contacting the surface of the alloy with a chromate-containing solution having a pH between about 0.5 and about 1.5; (ii) rinsing the surface with water; and (iii) contacting the surface, immediately after rinsing the surface with water, with a nitric acid solution.

Preferably, the concentration of the chromate solution is greater than about 15 grams per liter and about 20 grams per liter. A typical source of such a chromate solution is a commercial product known as Deoxidizer 7, manufactured by Parker & Amchem. Deoxidizer 7 is 70–80 percent potassium dichromate, 15–20 percent potassium nitrate, and 5–10 percent sodium bifluoride.

The pH of the chromate-containing solution is adjusted to between about 0.5 and about 1.5 by the addition of hydrochloric acid.

For aluminum-copper alloys having a copper content between about one percent and about two percent, this contacting step with an acidic chromate-containing solution should not be very long. Preferably, the period is less than about 20 seconds, most preferably between about 8 and about 12 seconds. Shorter periods of time will not effectively remove all of the copper from the surface. Longer periods of time will tend to corrode the aluminum content of the surface.

After the metallic matrix at the alloy surface has been substantially stripped of its copper content in the nitrate-containing solution, it is then promptly rinsed with water to remove all chemically reactive ions.

For the aluminum alloys having a copper content greater than about two percent, the contacting step with an acidic chromate-containing solution is preferably carried out for a period of time between about 8 minutes and about 12 minutes. Again, shorter periods of time will not effectively remove all of the copper from the surface, while longer periods of time will tend to corrode the aluminum content of the surface.

After the alloy surface has been substantially stripped of its copper content in the nitrate-containing solution, it is then promptly rinsed with water to remove all chemically reactive ions.

After being contacted with the acidic-chromate solution, the aluminum alloy is rinsed with water and then immediately immersed in a nitric acid solution. If the surface is not immediately immersed in the nitric acid solution, residual copper which typically continues to loosely adhere to the alloy surface will not be sloughed off of the surface.

The strength of the nitric acid solution is between about 15 and about 25 volume percent nitric acid. The temperature of the nitric acid solution is between about room temperature and about 50° C., preferably between about 40° and about 45° C. Warmer temperatures tend to cause corrosion attack of the aluminum contact at the surface.

The surface is contacted with the nitric acid solution for only between about one half minute and about two minutes. Longer periods of time will also tend to cause corrosion attack to the aluminum content of the alloy.

For aluminum alloys having a copper content between about one percent and about two percent, the unique electrochemical method of removing substantially all of the copper from the surface of the aluminum alloy comprises the step of contacting the surface of the alloy with a nitrate-containing solution having a pH between about 0.5 and about 1.5, while applying an electrical potential to the surface of the alloy. That electrical potential should be between about 240 mV and about 300 mV above the corrosion potential of the alloy. Smaller oxidation potentials will not effectively remove all of the copper.

The electrochemical contact should be carried out for between about 20 minutes and about 40 minutes.

Typically, the nitrate-containing solution is a sodium nitrate solution, such as a 0.5M solution.

The pH of the nitrate-containing solution is adjusted to between about 0.5 and about 1.5 by the addition of hydrochloric acid. Solutions having a lesser pH will tend to attack the aluminum content of the alloy surface. Solutions having a greater pH will not effectively remove all of the copper from the surface.

For aluminum alloys having a copper content greater than about two percent, the unique electro-chemical method of removing substantially all of the copper from the surface of the aluminum alloy comprises the step of contacting the surface of the alloy with a nitratecontaining solution having a pH between about 0.2 and about 0.4 while applying an electrical potential to the surface of the alloy. That electrical potential should be between about 120 mV and about 180 mV above the corrosion potential of the alloy. Again, smaller potentials will not effectively remove all of the copper, while larger potentials will tend to attack the aluminum content of the surface.

Again, the electrochemical contact should be carried out for between about 20 and about 40 minutes.

The nitrate-containing solution is typically a sodium nitrate solution, such as a 0.5M solution.

The pH of the nitrate-containing solution is adjusted to between about 0.2 and about 0.4 by the addition of nitric acid. Solutions having a lesser pH will tend to attack the aluminum content of the alloy surface, while solutions having a greater pH will not effectively remove all of the copper from the surface.

Once the copper has been substantially removed from the metallic matrix at the surface of the aluminum alloy, the surface can be effectively made corrosion resistant by any of the three methods discussed above, namely, anodizing, chromate passivation (by the application to the surface of a chromate-containing coating), or contact with cerium solutions. It has been found that the performance of all three methods are markedly increased for alloys having copper content greater than about one percent by the unique copper removal methods described above.

Preferably, after the metallic matrix at the surface of the alloy has been substantially removed of copper, the surface is subjected to the unique modified cerium solution method described below. This method has been found to be superior to any previously known method for protecting aluminum alloys of relatively high copper content.

In the unique cerium solution method of the invention, the metallic matrix at the surface of the aluminum alloy, after it has been substantially removed of all copper, is contacted with a first solution containing cerium. For aluminum alloys containing between one percent and about two percent copper, this first cerium solution is a cerium nitrate solution wherein the cerium concentration is between about 5 and about 20 millimoles, preferably between about 8 and about 12 millimoles. For aluminum alloys containing greater than about two percent copper, this first cerium solution is a cerium acetate solution wherein the cerium concentration is between about 2 and about 6 millimoles, preferably between about 3 and about 4 millimoles.

The solution is maintained at a temperature of at least about 80° C., preferably at least about 90° C., more preferably at at least about 98° C., and most preferably, just below the boiling temperature of the solution.

The surface is contacted with the first cerium solution for at least about one hour, preferably at least about 1.5 hours, and most preferably between about 1.5 hours and about 2 hours. Contact times in excess of 2 hours generally do not result in more favorable results.

After contact with the first cerium solution, the surface of the aluminum alloy is electrically charged while being contacted with an aqueous molybdate solution. The molybdate solution can be any convenient molybdate solution having a high solubility in water. Aluminum molybdate can be used as can other common molybdates known in the trade. Sodium molybdate is generally preferred because of its high solubility and ready availability.

The concentration of the molybdate in the solution is generally between about 0.05 and about 0.15 moles. The pH of the solution is controlled to between about 7 and about 9, preferably to between about 8 and about 9.

While being contacted with the molybdate solution, the surface is electrically charged within the passive region for the aluminum material. The potential must generally be more positive than the corrosion potential of the material and less positive than the potential at which the molybdate solution electrically decomposes. For aluminum alloys having a copper content in excess of about 1 percent, this potential is between about 500 and about 800 mV, preferably between about 650 and about 750 mV above the corrosion potential of the alloy.

The surface is polarized within the molybdate solution for at least about one hour and preferably greater than about 1.5 hours. Contact times in excess of two hours do not measurably increase results.

After being electrically charged within the aqueous molybdate solution, the surface is contacted with a second solution containing cerium. For aluminum alloys containing between about one percent and about two percent copper, this second cerium-containing solution is a solution of cerium chloride. For aluminum alloys having an excess of two percent copper, this second cerium-containing solution is a cerium nitrate solution.

As was the case with contact by the first cerium-containing solution, contact with the second cerium-containing solution is carried out at a temperature of at least about 80° C., preferably at least about 90°C., more preferably at at least about 98° C., and most preferably, just below the boiling temperature of the solution.

For aluminum alloys having a copper content between about one percent and about two percent, the concentration of the cerium in the second cerium-containing solution is between about 3 and about 7 millimoles, preferably between about 4 and about 6 millimoles. For aluminum alloys having a copper content in excess of about two percent, the concentration of the cerium in the second cerium-containing solution is between about 5 and about 20 millimoles, preferably between about 8 and about 12 millimoles.

Also as was the case with contact by the first cerium-containing solution, contact by the second cerium-containing solution is generally made in excess of one hour, preferably in excess of 1.5 hours, and most preferably between 1.5 and 2 hours. Contact times in excess of two hours generally do not yield increased results.

Surfaces treated by the invention form a very corrosion-resistant surface on aluminum alloys having a copper content greater than about one percent. The corrosion resistance is consistent and uniform throughout the surface. Surfaces treated by the invention have been found to be so corrosion-resistant as to be potentially useful in salt-water services.

Surfaces treated by the method of the invention are also smooth and uniform in appearance so that they can be used in architectural and other surfaces where ornamental appearance is an important consideration.

EXAMPLE 1

Samples of AL 7075-T6 were subjected to the following procedure:

1. The samples were degreased using Alconox detergent, rinsed with distilled water to remove the detergent and dried by air.

2. They were then deoxidized in a Diversey 560 solution for between about 10 and 15 minutes.

3. Substantially all of the copper was removed from the matrix at the surface of the samples by one of two methods. In a first method, samples were immersed for 10 seconds in a solution with 22.8 grams per liter of Deoxidizer 7, wherein the pH was adjusted to about 1.0 by the addition of hydrochloric acid. These samples were then rinsed with distilled water and immediately immersed in a 20 volume percent nitric acid solution at between about 40° C. and about 45° C. for one minute. These samples were then rinsed and dried. In a second method, samples were immersed for 30 minutes in a 0.5M sodium nitrate solution wherein the pH had been adjusted to about 1.0 by the addition of hydrochloric acid. During immersion, a potential of about −248 mV (as compared to a saturated calomel electrode) was applied to the surface. Thereafter, these samples were rinsed with distilled water.

4. All of the samples were then immersed in a 10 millimole solution of cerium nitrate at about 100° C. for about two hours. Thereafter, they were rinsed with distilled water.

5. The samples were then polarized in a 0.1 molar cerium molybdate solution while an electrical potential was applied to the surface of about 100 mV (compared to a mercury sulfate reference electrode). Polarization was carried out for about two hours. The samples were then rinsed with distilled water.

6. The samples were then immersed in a 5 millimole solution of cerium chloride at about 100° C. for about two hours. Thereafter, the samples were rinsed with distilled water.

After having undergone the above-described treatment, the samples were treated for resistance to localized corrosion and were found to be highly resistant.

EXAMPLE 2

Samples of Al 2024-T3 were subjected to the following procedure:

1. The samples were degreased using Alconox detergent, rinsed with distilled water to remove the detergent and dried by air.

2. They were then deoxidized in a Diversey 560 solution for between about 10 and 15 minutes.

3. Substantially all of the copper was removed from the matrix at the surface of the samples by one of two methods. In a first method, samples were immersed for 10 seconds in a solution with 22.8 grams per liter of phosphoric acid. These samples were then rinsed with distilled water and immediately immersed in a 20 volume percent nitric acid solution at between about 40° C. and about 45° C. for one minute. These samples were then rinsed and dried. In a second method, samples were immersed for 30 minutes in a 0.5M sodium nitrate solution to which had been added 60 milliliter per liter of nitric acid. During immersion, a potential of about −55 mV (as compared to a saturated calomel electrode) was applied to the surface. Thereafter, these samples were rinsed with distilled water.

4. All of the samples were then immersed in a 4 millimole solution of cerium acetate at about 100° C. for about 1.5 hours. Thereafter, they were rinsed with distilled water.

5. The samples were then polarized in a 0.1M sodium molybdate solution while an electrical potential was applied to the surface of about 100 mV (compared to a mercury sulfate reference electrode). Polarization was carried out for about two hours. The samples were then rinsed with distilled water.

6. The samples were then immersed in a 10 millimole solution of cerium nitrate at about 100° C. for about two hours. Thereafter, the samples were rinsed with distilled water.

After having undergone the above-described treatment, the samples were treated for resistance to localized corrosion and were found to be highly resistant.

As noted above, the present invention has been described in considerable detail with reference to certain preferred versions. However, other versions are possible. Therefore, the spirit and scope of the appended claims should not necessarily be limited to the description of the preferred versions contained herein.

What is claimed is:

1. A method for preparing the surface of an aluminum alloy for a corrosion prevention treatment, the method comprising the steps of:

a. Deoxidizing the surface of the alloy;

b. Contacting the surface with a chromate-containing solution having a pH between about 1.0 and about 1.5;

c. Rinsing the surface with water; and d. Contacting the surface, immediately after rinsing the surface with water, with a nitric acid solution.

2. The method of claim 1 wherein the concentration of chromate within the chromate-containing solution is about 15 grams per liter and about 20 grams per liter.

3. The method of claim 1 wherein the contacting of the surface with a nitric acid solution is carried out at between about 40° C. and about 45° C.

4. The method of claim 1 wherein the contacting of the surface with a nitric acid solution is carried out for between about one-half and about two minutes.

5. The method of claim 1 wherein the concentration of nitric acid in the step wherein the surface is contacted with a nitric acid solution is between about 15 and about 25 volume percent.

6. The method of claim 1 comprising the further step of, after contacting the surface with the nitric acid solution, passivating the surface by applying to the surface a chromate-containing coating.

7. A method for preparing the surface of an aluminum alloy for a corrosion prevention treatment wherein the alloy has a copper content between about one percent and about two percent, the method comprising the steps of:

a. Deoxidizing the surface of the alloy;

b. Contacting the surface with a chromate-containing hydrochloric acid solution having a pH between about 1.0 and about 1.5;

c. Rinsing the surface with water; and d. Contacting the surface, immediately after rinsing the surface with water, with a nitric acid solution.

8. The method of claim 7 wherein the surface is contacted with the chromate-containing solution for between about 5 and about 20 seconds.

9. A method for preparing the surface of an aluminum alloy for a corrosion prevention treatment wherein the alloy has a copper content greater than about two percent, the method comprising the steps of:

a. Deoxidizing the surface of the alloy;

b. Contacting the surface with a chromate-containing phosphoric acid solution having a pH between about 1.0 and about 1.5;

c. Rinsing the surface with water; and d. Contacting the surface, immediately after rinsing the surface with water, with a nitric acid solution.

10. The method of claim 9 wherein the contacting of the surface with a chromate-containing solution is carried out for a period of time between about 8 minutes and about 12 minutes.

* * * * *